US005896859A

United States Patent [19]

Carroll

[11] Patent Number: 5,896,859

[45] Date of Patent: Apr. 27, 1999

[54] TRANSFER BELT

[76] Inventor: John D. Carroll, 8102 Falmouth Dr., Austin, Tex. 78757

[21] Appl. No.: 09/000,832

[22] Filed: Dec. 30, 1997

[51] Int. Cl.[6] ..... A61G 15/00

[52] U.S. Cl. ..... 128/845; 128/869; 128/876; 602/19; 297/484

[58] Field of Search ..... 128/845, 846, 128/869–876; 602/19; 5/81.1; 297/484, 485

[56] References Cited

U.S. PATENT DOCUMENTS

| | | | |
|---|---|---|---|
| 1,310,958 | 7/1919 | O'Connor | 128/875 |
| 3,458,878 | 8/1969 | Combs | 128/876 |
| 3,769,938 | 11/1973 | Hudziak | 128/874 |
| 4,172,453 | 10/1979 | Leckie | 128/876 |
| 4,860,560 | 8/1989 | Lundelius . | |
| 5,031,639 | 7/1991 | Wolfer | 128/874 |
| 5,158,098 | 10/1992 | Jalalian . | |
| 5,253,657 | 10/1993 | Butterfield . | |
| 5,263,495 | 11/1993 | Butterfield . | |
| 5,269,324 | 12/1993 | Butterfield . | |
| 5,361,418 | 11/1994 | Luzenske . | |
| 5,397,171 | 3/1995 | Leach . | |

*Primary Examiner*—Michael A. Brown
*Attorney, Agent, or Firm*—Richard C. Litman

[57] ABSTRACT

A transfer belt including an adjustable waist belt and a harness strap, both of which are constructed of a pliant material. In one embodiment, the adjustable waist belt includes a first end terminating in a belt buckle having a slot through which a second end of the adjustable waist belt is extended. The harness strap of the belt is affixed proximal the first and second end of the waist belt. In other embodiments, a length adjuster is provided, handles may be positioned at the rear of the belt, and/or the belt buckle may be located to one side, beyond the front of the belt portion connecting the ends of the harness. To ensure correct placement of the transfer belt on a wearer, the outer surface of the waist belt and the harness strap are of one uniform color, while the inner surface of the waist belt and harness strap are of another uniform color. The harness strap is fitted by the user below the wearer's gluteals, and the adjustable waist belt is tightly secured by the user around the wearer's waist. The weight of the wearer can then be shifted by the user by pulling upward on the top portions of the harness strap affixed to the adjustable waist belt, to handles in the front at the harness ends, or to handles affixed to the rear of the belt.

15 Claims, 5 Drawing Sheets

TRANSFER BELT

BACKGROUND OF THE INVENTION

1. Field of the Invention

The present invention relates generally to devices for moving ambulation-impaired individuals, more particularly, to a transfer belt including an adjustable waist belt and a harness strap, which is adapted to be positioned under the gluteals of an individual, thereby increasing the ability of an assistant to support the individual while lifting.

2. Description of Related Art

In health care settings, moving an individual who is ambulation-impaired, incapable of self-movement or restricted to limited movement due to age, illness, physical disability, and the like, is a difficult and strenuous process for an assistant. Typical situations include moving the individual from a bed to a wheelchair, wheelchair to toilet, etc. Likewise, it is an uncomfortable and disconcerting process for the individual being moved.

Traditionally, a belt comprising a single adjustable strap, which is secured around a patient's waist, has been used to transfer such patients. This type of belt will often become displaced from a patient's waist during the transferrer process, thereby complicating the process and potentially injuring the patient. Another complication of the standard belt is the difficulty a transferrer has in finding a secure hold on the belt in order to accomplish a quick and steady transfer of the patient.

It would be useful, therefore, to have a transfer belt that would ensure correct and proper positioning around a patient's waist throughout the entire transfer process and to have a transfer belt equipped with conveniently located and easily graspable handles.

Examples of devices attempting to remedy some of these aforementioned difficulties can be seen in the following patents: U.S. Pat. No. 4,860,560 issued to Lundelius; U.S. Pat. No. 5,158,098 issued to Jalalian; U.S. Pat. No. 5,253,657 issued to Butterfield; U.S. Pat. No. 5,263,495 issued to Butterfield; U.S. Pat. No. 5,269,324 issued to Butterfield; and U.S. Patent No. 5,397,171 issued to Leach.

Examples of lifting devices including handles to aid in their use can be seen in the Butterfield patents. U.S. Pat. No. 5,253,657 discloses a harness comprising an adjustable body belt provided with a pair of side handles, to be fitted around an individual's upper body, encircling the torso and arms, and an elongated shoulder strap. The elongated shoulder strap, which is attached to the adjustable body belt, terminates in a large handle.

A moving harness employed by a user for moving or guiding the position of a human wearer is shown in U.S. Pat. No. 5,263,495. The moving harness comprises first and second body belts, each body strap having two handles, and a central strap attached to the first and second body straps, which includes a handle at either end. U.S. Pat. No. 5,269,324 teaches a patient lifting harness having an adjustable body belt attached to a shoulder strap provided with a large handle. The belt is fitted around the patient's upper body, encircling the torso and arms.

The patents to Luzenske (U.S. Pat. No. 5,361,418), Jalalian and Lundelius all share general structural aspects of the present invention, but each teaches away from and is not specifically adapted to aid in short distance physical transfer of a patient by supporting only the torso and upper legs, just beneath the glutei maximi. In Lundelius' patent, a restraining device is shown having a waist belt through which a harness strap passes, with a lower portion to be positioned in the crotch area of a wearer and a bifurcated upper portion to be positioned around a wearer's neck. Jalalian's patented device provides an orthotic pelvic belt equipped with a waistband, which can be adjusted by means of a belt buckle in conjunction with a plurality of holes, and a pair of grips on the rear of the waistband. The patent issued to Luzenske discloses a girdle-like safety device, formed by a flexible panel having a T-shaped configuration, to be worn around a user's waist. This configuration, which includes a plurality of handles, presents a pair of opposed arms that are secured about the waist of a user to form a band, and a single connecting element that extends front to rear under the crotch and is joined to the band.

U.S. Pat. No. 5,397,171 shows an assistance harness which solves several of the complications arising from the use of a standard belt. The apparatus comprises a belt to encircle the waist of a patient, a belt handle means on the rear section of the belt and a shoulder harness means securely attached to the belt. Although these aspects aid in a more comfortable and secure transfer of a patient, the complicated design of the apparatus and extraneous features, that allow the apparatus to be attached to a wheelchair, render the apparatus difficult to use and time consuming to employ.

None of the above inventions and patents, taken either singly or in combination, is seen to describe the instant invention as claimed.

SUMMARY OF THE INVENTION

The instant invention particularly relates to a transfer belt that provides increased control for an individual transferring an immobilized patient over a short distance. The invention includes a harness strap extended from the belt downwardly and around the upper thighs of the patient, in the vicinity of the glutei maximi, which increases the ease and safety with which an immobile patient can be lifted and moved. This additional feature also assists the individual transferring the immobile patient by preventing relative motion of the transfer belt around a patient's waist, thereby reducing the risk of possible injury to the transferrer due to the shifting weight of the immobile patient.

The improved transfer belt comprises an adjustable waist belt having at least one closure means and a harness strap, both of which can also be adjustable, which are constructed of a pliable, non-irritating material. Not only does this material allow for facile storage of the improved transfer belt, but also it adds to the comfort of an individual wearing the belt. The adjustable waist belt includes a single strap having a first and second end, with the first end terminating in a buckle component or slotted closure mechanism. The second end of the waist belt can be threaded through the slotted closure mechanism, or joined to a mating buckle component, thereby altering the circumference of the adjustable waist belt. A second embodiment includes a belt length adjustment means, such as pressure release snap buckle, which may be included along an intermediate portion of the waist belt to accommodate added length of the belt for use with patient's of wide girth. With either embodiment, a user can then tightly and easily secure the waist belt around the waist of a wearer regardless of the user's waist size.

The harness strap, which is longer in length than the adjustable waist belt, includes a first and second end. The first end of the harness strap is attached proximal the first end of the adjustable waist belt and the second end of the harness strap is attached proximal the second end of the adjustable waist belt. The harness strap depends downwardly from the adjustable waist belt, forming a closed loop inclusive of the waist belt and closed buckle (in one embodiment), permitting the harness strap to be placed under the gluteals of a wearer while the belt strap is secured around a wearer's waist. In an alternative embodiment, the buckle and strap end are located outside of the waist belt portion between the two harness strap ends.

In another alternate embodiment of the transfer belt, a first and second handle are provided on the outer surface of the adjustable waist belt. The first handle is positioned at the first end of the harness strap and the second handle is positioned at the second end of the harness strap; both handles are aligned parallel the length of the harness strap. This feature and its configuration allow an individual transferring a wearer to do so with greater safety for both the wearer and the transferrer by permitting a transferrer to have a firm and stable grip upon the transfer belt without contacting the body of the wearer.

As yet a further modification, the waist belt could have two handles attached toward the rear of the waist belt, in the kidney region of the patient, approximately. Such positioning of handles makes it a bit easier to lift rather heavy patients, and improves the body mechanics of the aide lifting the patient, thus reducing the possibilities of any injury to both patient and aide.

A further modification of the invention may include a color coding system. The outside surface of both the adjustable waist belt and the harness strap are dyed a single, uniform color, while the interior surface of the adjustable waist belt and the harness strap are dyed another single, uniform color in order to differentiate the exterior from the interior of the transfer belt. This differentiation ensures the correct placement of the improved gain belt around the waist and under the gluteals of the wearer. The user can ascertain the interior surface of the waist belt by color, accurately place the interior surface under the gluteals of a wearer and, then, fasten the adjustable waist belt securely around a wearer's waist.

Accordingly, it is a principal object of the invention to provide a transfer belt which ensures safe and easy transference of an individual.

It is another object of the invention to provide a transfer belt having a harness strap.

It is a further object of the invention to provide a transfer belt including a pair of handles.

Still another object of the invention is to provide an transfer belt with an outer surface of one uniform color and an inner surface of another uniform color.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
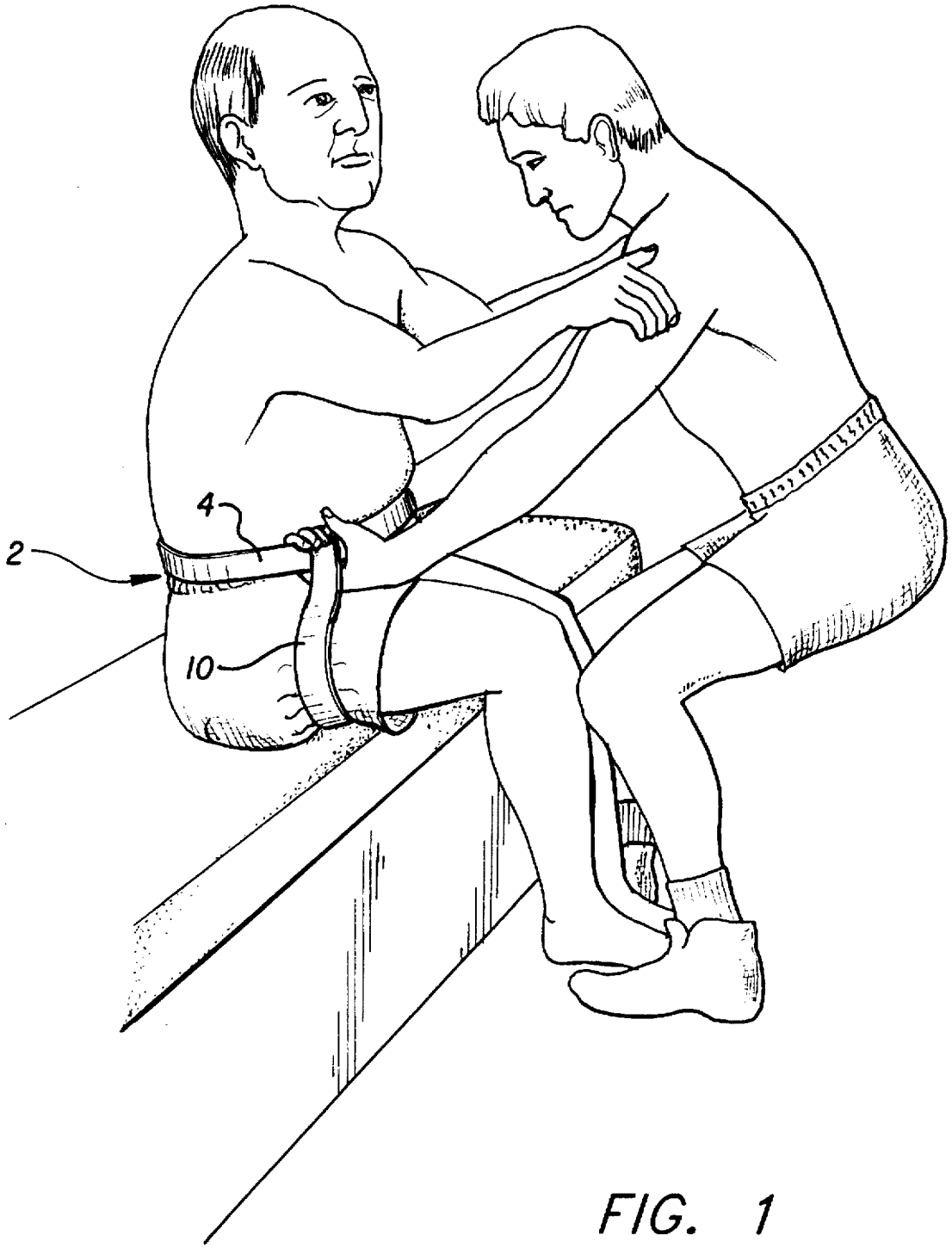
FIG. 1 is an environmental, perspective view of a transfer belt being utilized to transfer an individual.

The present invention is a transfer belt 2 shown in use in FIG. 1. The transfer belt 2, which is clearly shown as a preferred embodiment in FIG. 3, comprises an adjustable waist belt 4 having a buckle or other slotted closure member 18 and a harness strap 10 which may also be adjustable. Both the adjustable waist belt 4 and the harness strap 10 are constructed of a non-abrasive, pliable material, which provides greater comfort to a wearer of the transfer belt 2 and permits easy storage of the transfer belt 2.

Figure 2:
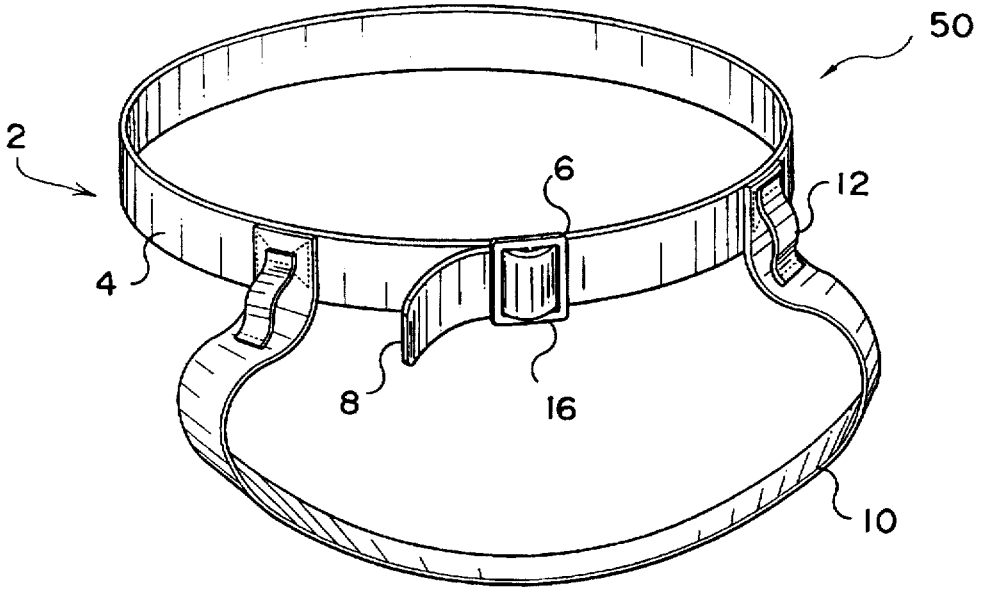
FIG. 2 is a perspective view of the transfer belt with handles shown in a closed configuration.
Figure 3:
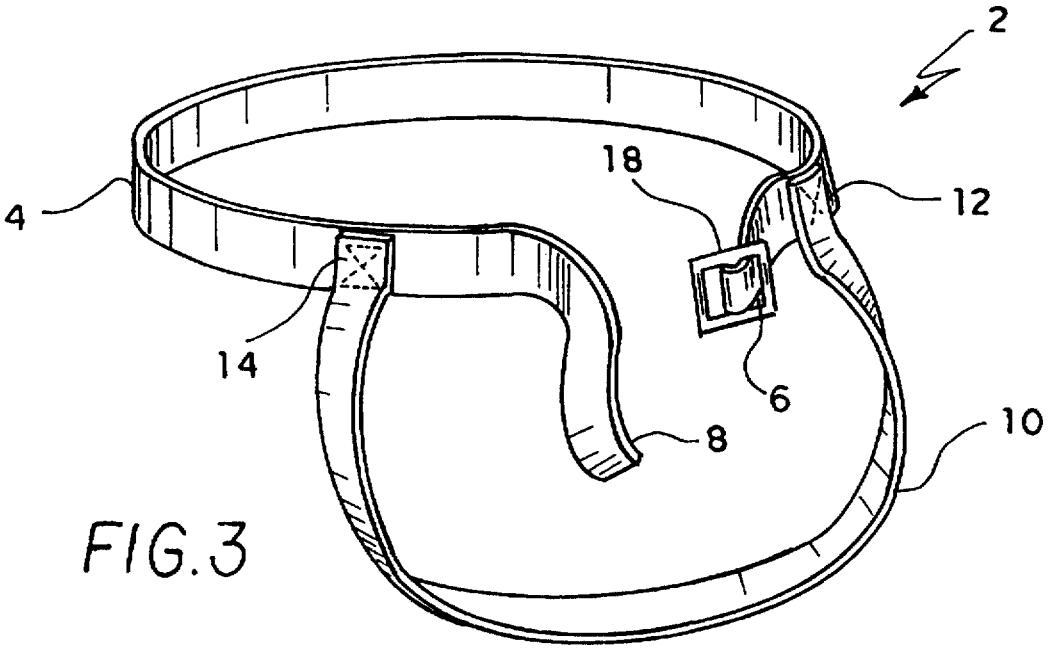
FIG. 3 is a perspective view of an alternative embodiment of the transfer belt, without handles, shown in an opened configuration.

The adjustable waist belt 4 includes a first end 6 and a second end 8, with the first end 6 being attached to the slotted closure member 18. As shown in FIGS. 1, 2 and 3, the slotted closure member 18 is of a construction having a square Perimeter with a transverse vertical rail to which the first end 6 is attached, the vertical, central rail being disposed medially between and parallel to the side rails of the square perimeter. The second end 8, which is free as shown in FIG. 3, is dimensioned to fit within the slotted closure member 18, thereby permitting adjustment in the circumference of the adjustable waist belt 4, and allowing the adjustable waist belt 4 to be maintained in a closed position, as shown in FIG. 2.

In one alternative embodiment, and as shown in FIG. 2, the adjustable waist belt 4 is equipped with a pair of handles 16 affixed on the outer surface of the adjustable waist belt 4, each handle being affixed to an end of the harness strap 10, at its junction with the waist belt 4, and to the body of the harness strap 10. The handles are obviously provided as additional grasping points, which may be positioned proximate the hands and consistent with the lifting position shown in FIG. 1, so that the fingers can be slipped into the handle's loop from below. Moreover, the handles 16 eliminate the need for placing the hands below the waist belt 4 and thereby eliminate the possible risk of discomfort or injury to either the patient or assistant due to grasping the waist belt directly.

With further reference to FIG. 1, the proper body mechanics of the aide or transferrer, seen to the right of the view, and the patient, seen in the left hand part of the view, will be explained. As can be appreciated form FIG. 1, the seated patient has his or her legs drawn together and the feet placed together, flat on the floor. The aide stands with his or her feet outboard of, but adjacent the patient's feet, and overlapping the patient's feet by about four inches or half to two-thirds a foot length. The aide's knees are positioned outside of but adjacent the patient's knees. The aide's body is bent at the waist to accomplish the lift and transfer, and not at the waist. The aide then grasps the harness strap ends and adjacent waist belt portions as shown in FIG. 1 and lifts the patient upwardly. The same procedure holds when the belt 4 is equipped with handles, as per other embodiments discussed infra, and shown in FIGS. 2 and 8.

Figure 8:
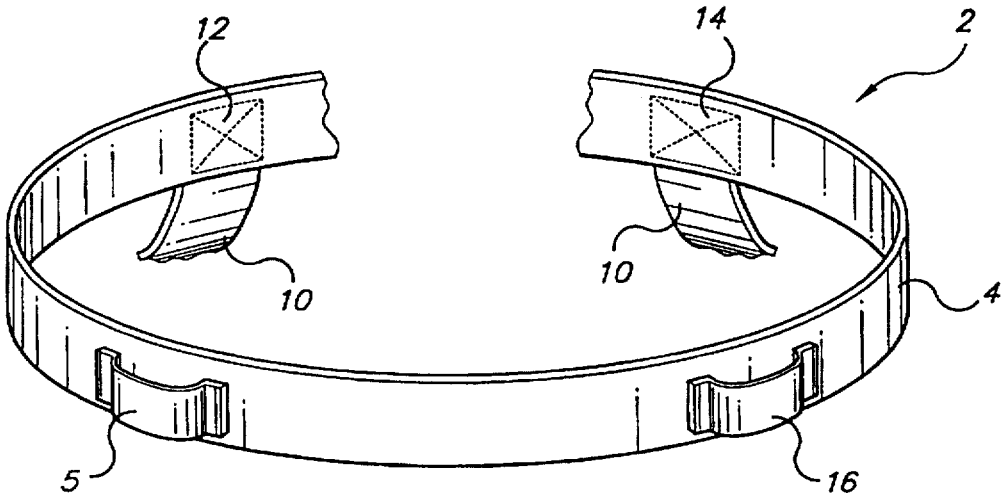
FIG. 8 is a fragmentary perspective view of a further embodiment of the transfer belt, with lifting assist handles being provided at the rear of the waist belt, in an area corresponding to the kidney area of the patient.

Obese and/or non-load bearing patients can be particularly difficult to lift. To make the transfer exercise even easier, handles 16 may be located as shown in FIG. 8, in the rear of the waist belt 4, in areas corresponding approximately to the kidney areas of the patient. The transferrer or aide in this case simply surrounds the patient with his or her arms extending about threefourths about the patient as a lift and transfer exercise is conducted.

The harness strap 10 is slightly longer in length than the adjustable waist belt 4 in its most extended position and includes a first and second end 12, 14. The first end 12 of the harness strap 10 is cross-stitched proximal the first end 6 of the adjustable waist belt 4 and the second end 14 of the harness strap is cross-stitched proximal the second end 8 of the adjustable waist belt 4. The harness strap 10 depends downwardly from the adjustable waist belt 4 when the adjustable waist belt 4 is in a generally horizontal position relative to a planar surface. Referring to FIGS. 2–4 and 7–8, the harness strap 10 retains its looped configuration. This looped configuration is adapted to cradle the gluteals of the wearer, at the junction of the gluteals and upper thighs of the wearer.

As a further option, the outside surface of both the adjustable waist belt 4 and the harness strap 10 are dyed one uniform color, while the inside surface of both the adjustable waist belt 4 and the harness strap 10 are dyed a different uniform color. This differentiation allows a user to correctly position the transfer belt 2 around the waist and under the gluteals of a wearer. In the alternate embodiments shown in FIGS. 2 and 8, the pair of handles 16, 16 will be dyed the same color as the outside surface of the adjustable waist belt 4 and the harness strap 10.

Figure 4:
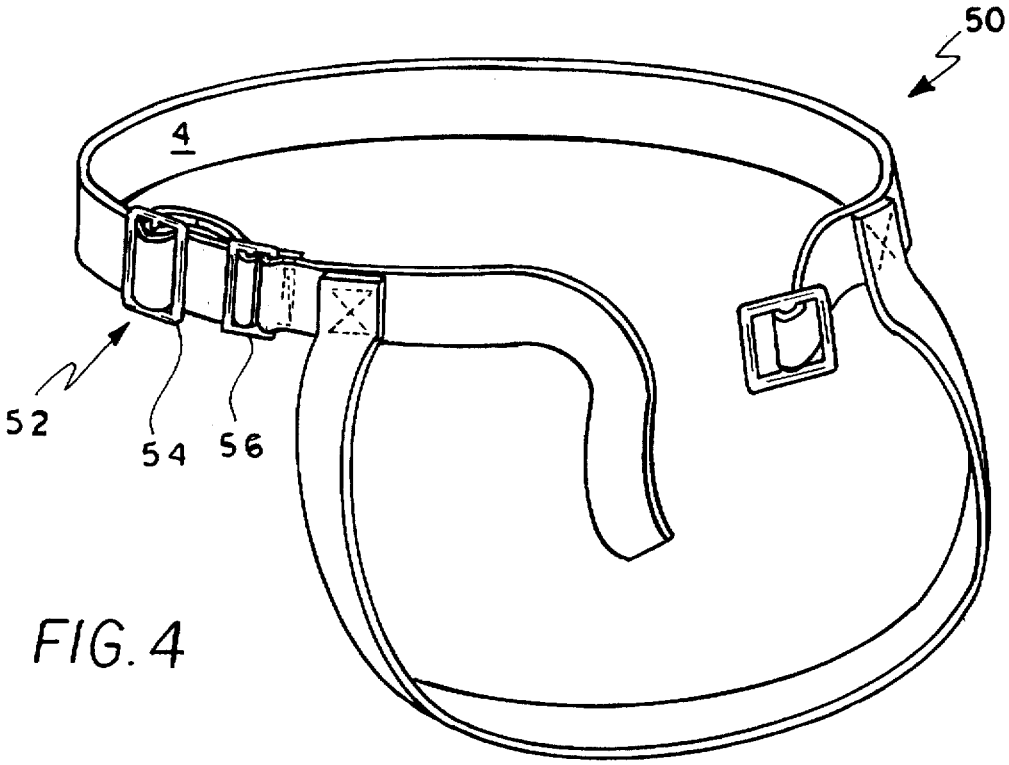
FIG. 4 is a second alternative embodiment of the transfer belt, with a length adjustment assembly of the waist belt, shown in an opened configuration.
Figure 5:
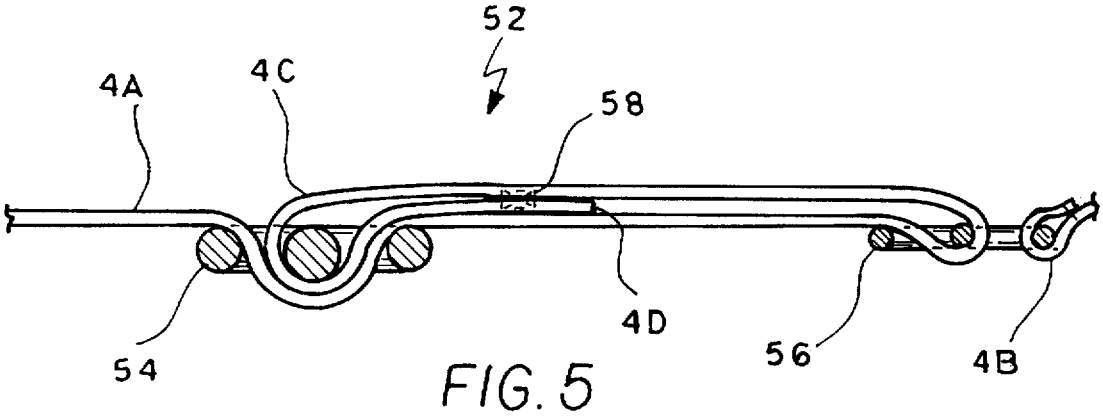
FIG. 5 is a detail, top plan view of the length adjustment assembly of the transfer belt.

FIG. 4 shows yet another embodiment of the belt 50 which incorporates, in addition to those necessary elements noted above, a length adjusting assembly 52, shown in greater detail in FIG. 5. The assembly 52 comprises a first buckle 54 and a second buckle 56 through which a portion of the waist belt 4 is drawn. The waist belt 4 includes a first portion 4*a*, attached to first buckle 54, and a second portion 4*b*, attached to second buckle 56. The first portion 4*a* provides an elongated length of belt in substantial excess of that necessary encircle the average human waist. An end portion 4*c* of first portion 4*a* is formed by means of a loop attached by stitching 58 the free end 4*d* to the end portion 4*c*. During construction, the formed loop is attached about a center post of buckle 54, thereby terminating first portion 4*a* with the buckle 54. However, during construction and before forming the loop, the buckle 54 is slid onto first portion 4*a* by passing free end 4*d* through the buckle 54, and then slidably connecting the first portion 4*a* to the second buckle 56 by passing the free end 4*d* therethrough. Thus, upon forming the loop attached to the first buckle, an inseparable length adjustment assembly 52 is formed.

Figure 6A:
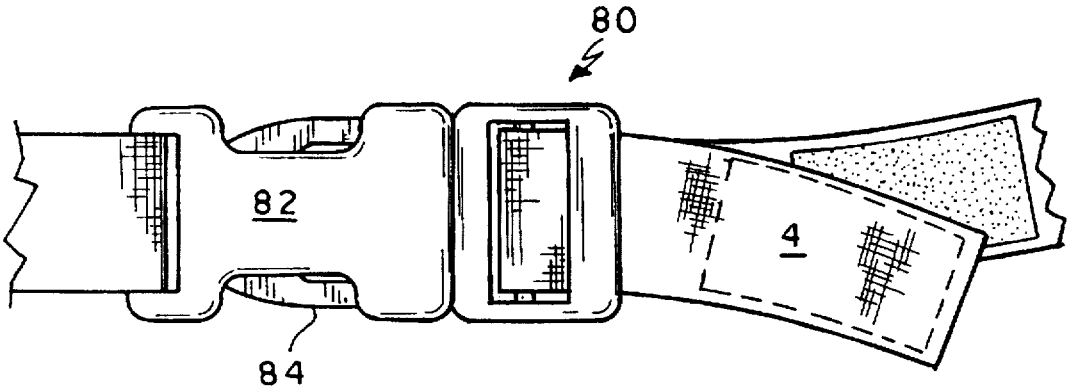
FIGS. 6A and 6B are front and rear views, respectively, of a preferred buckling system for use with the transfer belt according to the present invention.
Figure 6B:
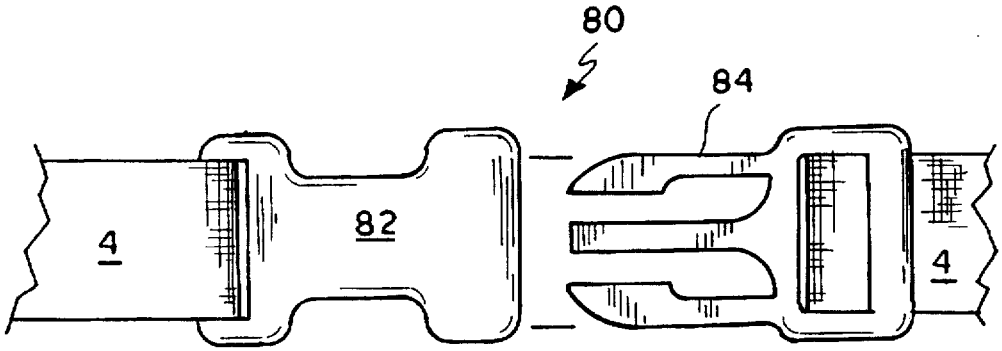

The waist belt may be made adjustable by other buckling means commercially available in the prior art. For example, the waist buckle 18 or assembly 52 may be substituted with the type of buckle assembly 80 shown in FIGS. 6A and 6B. Thus the belt 2 may comprise with the first end and second end both terminating in a buckle component. A buckle assembly 80 includes a mating components 82,84 which engage as pressure release snap buckle, thus allowing simple finger pressure to be exerted onto the assembly 80 to release the transfer belt 2. With any embodiment, a user can then tightly and easily secure the waist belt around the waist of a wearer regardless of the user's waist size.

Figure 7:
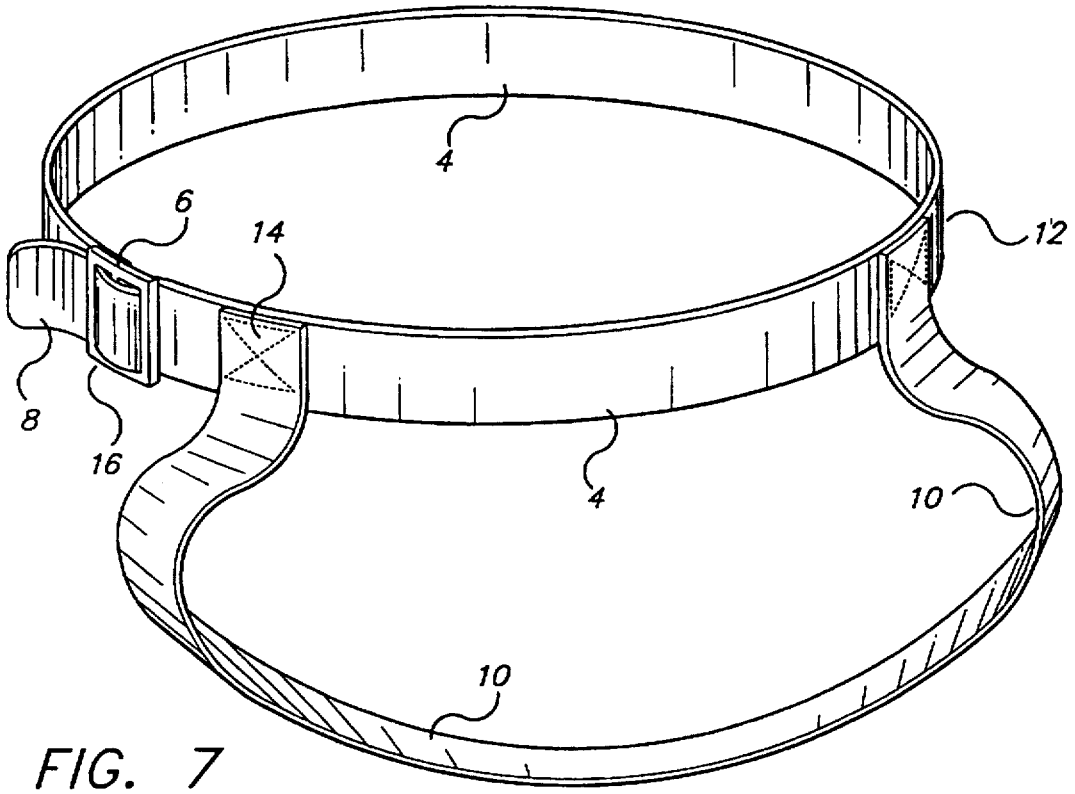
FIG. 7 is a perspective view of another embodiment of the transfer belt, with the belt buckle located to one side of the belt, outside the end of the harness strap.

As another alternative, and as seen in FIG. 7, the buckle or closure is located outside of the belt portion between the harness strap ends at the front of the belt. The length adjusting assembly 52 discussed above could be located on the other side of the belt in this embodiment, if desired.

It is to be understood that the present invention is not limited to the embodiments described above, but encompasses any and all embodiments within the scope of the following claims.

I claim:

1. An transfer belt comprising:

an adjustable waist belt fabricated from a pliable material and having a first and second end, said adjustable waist belt including a closure member attached to said first end, wherein said closure member is provided with an opening sized to receive said second end of said adjustable waist belt such that said second end can be selectively passed through said closure member and frictionally engaged thereby, permitting adjustment of said adjustable waist belt; and a harness strap of pliable material having a first and second end, said first end of said harness strap being affixed to said adjustable waist belt at a first predetermined location on said adjustable waist belt and said second end of said harness strap being affixed to said adjustable waist belt at a second predetermined location on said adjustable waist belt, said harness strap depending from said adjustable waist strap to form a loop;

whereby said harness strap may be positioned under the gluteals of a wearer and, then, said adjustable waist belt be securely fitted around a wearer's waist.

2. The transfer belt according to claim 1, including a first handle positioned proximal said first end of said harness strap.

3. The transfer belt according to claim 2, including a second handle positioned proximal said second end of said harness strap.

4. The transfer belt according to claim 1, wherein said waist belt and said harness strap together form an outside surface and an opposing inside surface, said outside surface being of one uniform color and said inside surface of said adjustable waist belt and said harness strap being of another visually distinct uniform color.

5. The transfer belt according to claim 1, further including an adjustment means for adjusting the length of said waist belt, said second means interposed upon said waist belt and being integral therewith.

6. The transfer belt according to claim 5, wherein said waist belt is interposed by said adjustment means so as to define a first portion and a second portion of said waist belt, and wherein said adjustment means comprises a first buckle having a center post, said center post being attached to said first portion and a second buckle being attached to said second portion, the first portion slidably passing through both said second buckle and said first buckle thus to form an inseparable assembly.

7. The transfer belt according to claim 5, wherein said adjustment means comprises a buckle assembly including mating components for removably engaging one another and allowing finger pressure to be exerted onto the assembly to release the assembly.

8. An transfer belt comprising:

an adjustable waist belt fabricated from a pliable material and having a first and second end, said adjustable waist belt including a first closure member attached to said first end and a second closure member for matingly and removably engaging said first closure member attached to said second end, thereby forming a closure assembly for permitting adjustment in length of said adjustable waist belt; and a harness strap of pliable material having a first and second end, said first end of said harness strap being affixed to said adjustable waist belt proximal said first end of said adjustable waist belt and said second end of said harness strap being affixed to said adjustable waist belt proximal said second end of said adjustable waist belt, said harness strap depending from said adjustable waist strap to form a loop when said closure member and said second end are engaged;

whereby said harness strap may be positioned under the gluteals of a wearer and, then, said adjustable waist belt be tightly fitted around a wearer's waist.

9. The transfer belt according to claim 8, including a first handle positioned proximal said first end of said harness strap.

10. The transfer belt according to claim 8, including a second handle positioned proximal said second end of said harness strap.

11. The transfer belt according to claim 8, wherein said waist belt and said harness strap together form an outside surface and an opposing inside surface, said outside surface being of one uniform color and said inside surface of said adjustable waist belt and said harness strap being of another visually distinct uniform color.

12. The transfer belt according to claim 8, further including an adjustment means for adjusting the length of said waist belt, said second means interposed upon said waist belt and being integral therewith.

13. The transfer belt according to claim 12, wherein said waist belt is interposed by said adjustment means so as to define a first portion and a second portion of said waist belt, and wherein said adjustment means comprises a first buckle having a center post, said center post attached to said first portion and a second buckle attached to said second portion, the first portion slidably passing through both said second buckle and said first buckle thus an inseparable assembly.

14. The transfer belt according to claim 13, wherein said adjustment means comprises a buckle assembly including mating components for removably engaging one another and allowing finger pressure to be exerted onto the assembly to release the assembly.

15. The transfer belt according to claim 8, wherein said first and said second closure members comprises a buckle assembly including mating components for removably engaging one another and allowing finger pressure to be exerted onto the assembly to release the assembly.

* * * * *